US005992634A

United States Patent [19]

Woodring et al.

[11] Patent Number: 5,992,634

[45] **Date of Patent: *Nov. 30, 1999**

[54] PACKAGE, PRODUCT AND METHOD THAT FACILITATES DISPOSAL OF SPENT PRODUCTS CONTAINING HAZARDOUS WASTE

[75] Inventors: Jeff Keven Woodring; Charles Lostak, both of Littleton, Colo.

[73] Assignee: Johns Manville International, Inc., Denver, Colo.

[ * ] Notice: Under 35 U.S.C. 154(b), the term of this patent shall be extended for 20 days.

[21] Appl. No.: 08/560,912

[22] Filed: Nov. 20, 1995

[51] Int. Cl.[6] ..... B65D 85/84

[52] U.S. Cl. ..... 206/524.3; 206/524.5; 229/117.28

[58] Field of Search ..... 206/524.5, 524.1, 206/524.3, 443, 446; 220/403, 507; 229/125.39, 198.2, 199, 183

[56] References Cited

U.S. PATENT DOCUMENTS

| | | | |
|---|---|---|---|
| 1,883,938 | 10/1932 | Killeffer | 229/125.39 |
| 2,348,622 | 5/1944 | Heilman | 206/524.3 |
| 3,539,360 | 11/1970 | Wood | 220/403 |
| 4,197,963 | 4/1980 | Nerenberg | 220/462 |
| 4,318,475 | 3/1982 | Robinson | 206/524.3 |
| 4,574,998 | 3/1986 | Vavra | 206/320 |
| 4,978,028 | 12/1990 | George et al. | 220/403 |
| 5,145,108 | 9/1992 | Pinckney et al. | 229/125.39 |
| 5,226,555 | 7/1993 | Kovaleski | 220/403 |
| 5,452,800 | 9/1995 | Muir | 206/524.3 |

OTHER PUBLICATIONS

Westvaco, "Fibre Box Handbook", 1989 edition, pp. 62–66.

*Primary Examiner*—Paul T. Sewell
*Assistant Examiner*—Luan K. Bui
*Attorney, Agent, or Firm*—Robert D. Touslee

[57] ABSTRACT

New product intended for use with hazardous materials is packaged in a container that is also capable of being used to ship and dispose of the spent product containing hazardous materials meeting the requirements of UN NA 3085 for Group II Packs for UN DOT Group II hazardous materials and being also capable of being ground up and used for fuel in the manufacture of cement. This method of shipment and novel package is especially useful for shipping filter cartridges intended to be used to filter hazardous materials and to dispose of the spent filter cartridges, producing a novel new product useful as a shipping package and as fuel. Also disclosed is a new filter cartridge that simplifies the new method and package, and the method of making the cartridge.

32 Claims, 3 Drawing Sheets

PACKAGE, PRODUCT AND METHOD THAT FACILITATES DISPOSAL OF SPENT PRODUCTS CONTAINING HAZARDOUS WASTE

FIELD OF THE INVENTION

This invention involves a unique manner of shipping products which can become hazardous after use, such as filtration products, which product, package and method make it easier and less expensive for the user of the product to dispose of the spent products which are deemed hazardous by the various environmental agencies. The invention includes a unique filtration product, a unique package and a unique method of using the filtration product and/or package to easily, safely and relatively inexpensively dispose of the spent filtration product or other spent products.

BACKGROUND

Products such as filtration products of various types are used to filter, contain or process liquids and gases including the removal of solid, usually particulate, impurities therefrom. Filters remove unwanted solids from gases or liquids by an attraction affinity for the solids or by physically trapping the solids within the structures of the filters. Filters are used to remove all sizes of particles from removing bacteria from air going to hospital operating rooms or integrated circuit clean rooms to removing metal powder from engine oil.

Many of the solids removed, or the fluids being filtered, are considered hazardous by various governmental environmental agencies and in these cases the spent filters must be treated as hazardous waste and disposed of accordingly. This can become very expensive, in terms of out of pocket expenses for disposal containers and additional freight costs, and also terms of increased labor cost to handle extra paperwork, in addition to the higher landfill or disposal charges compared to non hazardous wastes. Normally, hazardous materials must be disposed of by incineration, either in an incinerator or in a furnace operated primarily for another purpose, but having a temperature and processing a product suitable to incinerating hazardous waste, such as cement kilns.

As an example of current practice, fibrous glass filter tubes have been used for many years to filter liquids and the spent filter cartridges very often must be treated as hazardous wastes and disposed of in a precise manner. In a common practice of disposing of spent filters the spent cartridges are placed a heavy plastic bag inside 55 gallon steel drums. When the drum is full, holding about fifty three 30 inch cartridges, the plastic is sealed at the top, a steel lid is attached and locked on with a steel latch. The filled steel drums are then banded to a pallet, three or four drums to the pallet, and picked up by a hazardous waste disposal company, but only after extensive paperwork is completed. Also, the filter cartridge user must dispose of the cardboard cartons that the filter cartridges were received in, which adds another nonproductive cost, as far as the manufacturer's products and customers are concerned and the disposal company must clean the steel drums for reuse or disposal.

Another method and product for disposing of hazardous materials is disclosed in U.S. Pat. No. 5,323,922 and involves expensive containers, time consuming assembly and do not address the problem of disposing of the packaging material in which the initial product was received.

SUMMARY OF THE INVENTION

In the present invention a unique package has been developed that not only serves to deliver products like filter products to the user in good condition, but more importantly can then be used in a particular way to contain and dispose of the spent and often hazardous products, including filter cartridges, thereby saving the customer the cost of disposing of packaging materials, buying expensive containers to contain and dispose of the spent products and paying high freight and disposal costs. Because this package meets environmental agency standards for hazardous materials such as UN DOT Group II and III, it greatly reduces the paperwork required by regulations and hazardous waste disposers and instead of paying freight and disposal costs, the customer can often sell the spent product package of the present invention to disposal companies or to energy intensive material processing companies like cement manufacturers to grind up and use as fuel and material supplements.

When this unique package, which includes a critical corrugated kraft (cardboard) box, is filled with unused filter products and sealed for shipment, this package of filters is a new product. Also disclosed is a new filter cartridge having at least partially flared and recessed core liners. A package comprising a cardboard box containing product having an exterior joining flap glued to a vertical surface of said box and extending for at least almost the entire height of the box when the latter is closed, the box having closure flaps on the top and the bottom, the cardboard being at least about 300 pound (pounds per square inch burst strength per TAPPI T-810 test) C/B Double wall, which is substantially higher than required to protect the product from expected shipping and handling abuse, the closure flaps on the bottom and top of the box being fastened shut.

Preferably the cardboard is at least about 325 pound C/B Doublewall, most preferably about 350 pound or higher C/B Doublewall, and the box, after closing the bottom, is first taped down the center in the conventional manner and then taped completely around the periphery of the bottom of the box with tape attached to the bottom end flaps and the vertical walls of said box and finally another strip of tape is placed over the first strip of tape down the center and over the peripheral tape and up the sides of the box a few inches. In accordance with the present invention it is not necessary to tape the bottom end of the box in this manner until the box is being prepared to receive hazardous waste, but it is preferred to do this prior to shipping the product to save the customer from having to do so. Since the package of spent product is often salable and novel, it too is an embodiment of the present invention.

Also preferably, the package further contains a liner bag made from a flexible plastic film, the bag being larger than the box, and a partitioning member located inside said bag and inside the box to divide the interior of the box into compartments, each compartment being large enough to hold one or more usable products. The package can optionally also contain cartridge sleeves made from flexible plastic film for containing the spent hazardous product, and protective members, such as plastic discs for protecting the ends of the cartridge sleeves from being punctured or abraded by the ends of core liners in the spent filter cartridges.

Using this package in a prescribed manner for also shipping and disposing of hazardous spent filters is a novel new method of disposing of hazardous spent product, like filters. Thus a method of disposing of products containing hazardous waste wherein original new product is made a part of a package comprising a cardboard box containing product and having an exterior joining flap glued to a vertical surface of said box and extending for at least almost the entire height of the box when the latter is closed, said box having closure flaps on the top and the bottom, said cardboard having a burst strength of at least 300 pounds and which is substantially higher and stronger than required to protect the product from expected shipping and handling abuse, said closure flaps on the bottom and top of the box being fastened shut and wherein said box is opened without damaging the strength of said cardboard box, original product is removed from said box and used creating spent product containing hazardous waste and wherein said spent product is disposed of by the steps comprising;

a) placing said spent product in a sleeve made from plastic film having a very low permeability and sealing said sleeve to prevent escape of said hazardous waste, b) placing said sleeve containing said spent product inside a compartment formed by a partitioning separator inside a bag liner made from a plastic film inside said box, c) repeating steps a and b until the compartments are filled, d) removing excess air from the bag liner by bringing the top together, squeezing out the excess air from the top of the liner and twisting the top of the bag liner into a tight plastic strand or rope like tail, e) sealing the tail closed so that it will not come open by any conventional means, such as by taping the tail close to the top of the box and then folding the excess tail down over the taped portion and taping these two segments together tightly, and f) closing said closure flaps to close the box and taping such that the top and bottom of the box is taped shut with a tape and pattern that meets the requirements established for United Nations Certification of a combination package for UN NA 3085 for Group II Packs.

The invention is useful on many types of products that end up with hazardous material in or on the product and is particularly useful on filtration products such as filter cartridges, but is also useful for containers of hazardous material, spill absorbent products, etc.

The present invention also includes a new type of a filter cartridge having a filtration media member with a cylindrical core and having a permeable core liner therein, said core liner being of shorter than the length of said core with the ends of said liner being recessed from the ends of said cartridge and having means to prevent said core liner from sliding along the length of said core. A preferred embodiment of the filter cartridge has a core liner of metal or thermoplastic in which the end portions of the core liner have been flared into the filtration media surrounding the core liner, locking the core liner onto the filtration media portion of the cartridge and creating a recess on each end of the cartridge between the ends of the core liner and the ends of the cartridge. This cartridge is much easier and cheaper to dispose of using the package of the present invention than the conventional core lined cartridges because it does not require protective discs to avoid damage to the plastic sleeves and the bag liner.

This new cartridge is made by flaring the ends of metal core liners using conventional metal tube flaring apparatus and techniques. When thermoplastic core liners are used the ends of the core liner for a distance to be flared are first heated to a temperature above the softening point of the thermoplastic and then flared quickly with chilled flaring tools and the tools are held against the flared thermoplastic ends of the core liner until the thermoplastic has cooled sufficiently to retain their flared shape.

DETAILED DESCRIPTION OF THE INVENTION

Typically industrial products such as filters, etc. are packaged in a way to insure that the product will get to the customer in a neat and secure manner, barring unreasonable abuse. Unless the product is a consumer product where aesthetics of the package is thought important to the sale of the product, the package is designed to cost as little as possible. Thus the concept of this invention goes contrary to essentially universal package design philosophy by designing the package to meet a much more stringent requirement of a secondary use by the customer, which requirement substantially raises the cost of the package to the supplier. The requirements for the package and system according to this invention are not just a package that will protect the new product against a reasonable amount of abuse in shipment, storage and handling, but instead is a package that will protect the spent products against an unreasonable amount of abuse in shipment, handling and storage, an unobvious packaging concept, particularly for filtration and similar products.

The packages used in the past for a filtration product like a fibrous glass filter tube for filtering liquids was a corrugated cardboard box, the cardboard being 150–200 pound burst strength, with a conventional internally glued joining flap and a conventionally taped shut lid and bottom. The filter cartridges, which typically measure about 3 inches in diameter and are of various lengths, were placed into the unlined cardboard package on end with no separation between the cartridges. The package was sized to hold a given number of cartridges in snug relationship. This package was normally discarded after the filter cartridges had been used as it was unsuitable for shipping the spent cartridges, particularly if they were considered hazardous.

The package of the present invention was developed, after many tests and at substantial expense, to meet not only the requirements of getting the product to the customer in expected condition, but to meet the more rigorous requirement of also functioning as a package for disposing of the spent and hazardous product meeting the requirement of UN-DOT Groups II and III, which have previously been met with 55 gallon steel drums and locked on lids, or with costly packaging materials like those disclosed in U.S. Pat. No. 5,323,922. The present invention will be described for use on filter cartridges, but the broad invention concept can also be used on other products where the product or product container after use is hazardous and must be disposed of under these or similar regulations.

Figure 1:
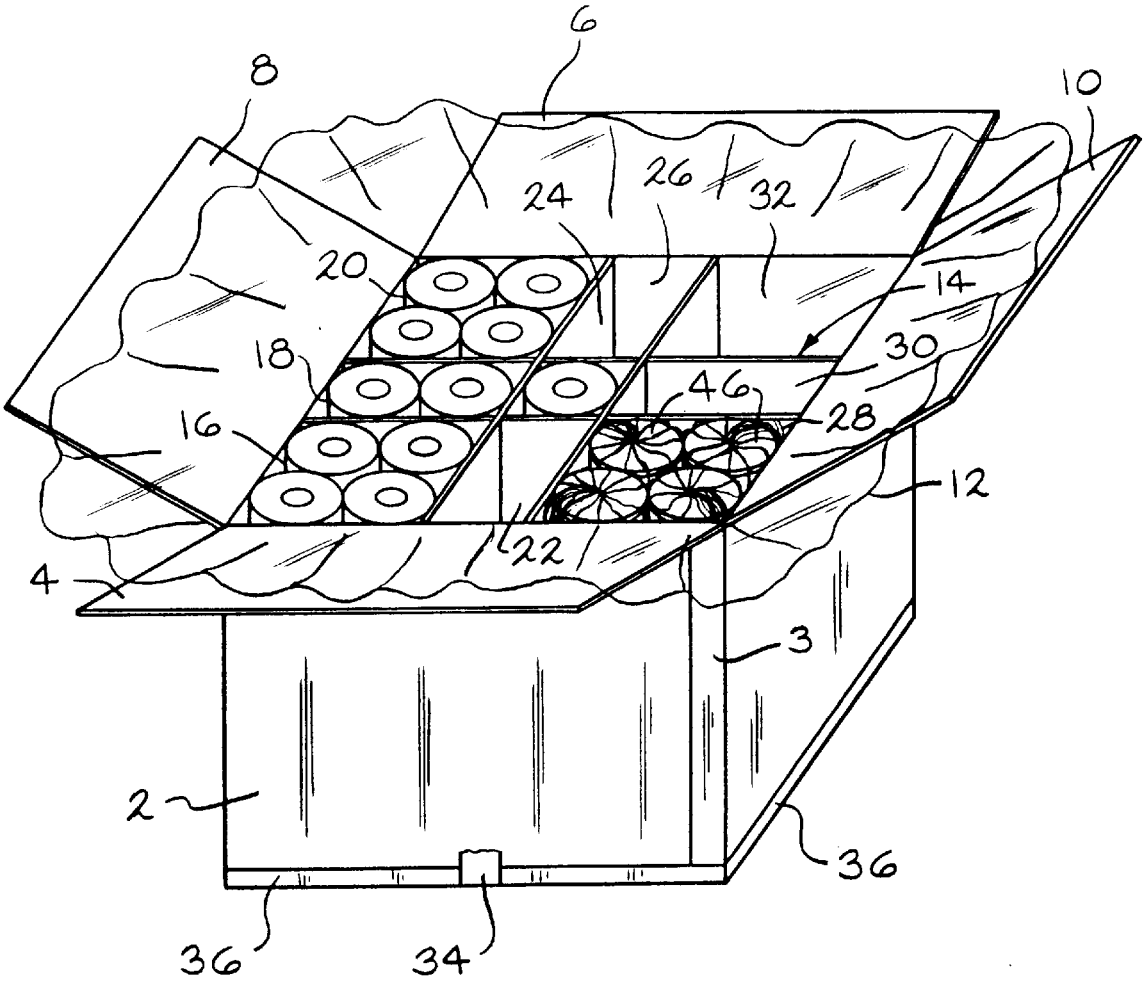
FIG. 1 is a perspective view of the package of the present invention after several new filter cartridges have been removed and showing how the package container is reused to contain spent filter cartridges.

Referring to FIG. 1, to meet the rigorous requirements of these UN-DOT standards, the cardboard box 2 first had to be much stronger than the box conventionally used to ship filter cartridges. Corrugated kraft or cardboard of at least about 300 pounds C/B Doublewall, preferably at least about 325 pounds and most preferably about 350 pounds is used. The C/B is a conventional designation meaning a C flute and a B flute are combined to make the corrugated cardboard in a know manner. The box 2 has a joining flap 3 that overlaps and is bonded to the outside of one of the vertical surfaces of the box with any conventional waterproof adhesive used to fabricate cardboard boxes. This joining flap 3 is more than 0.9 inches wide and preferably is about two inches wide or more and extends for almost the entire height of the box, preferably with very slight angled relief downwardly on each end towards the centerline of the box 2 to avoid interference with folding the end flap 4 and the corresponding end flap on the bottom of the box 2. Conventionally the joining flap on cardboard boxes is on the inside of the box where it is not visible from the outside. However, in the present invention an inside flap unexpectedly caused failure in the UN-DOT Group II and III tests and therefore it is critical to put the joining flap on the exterior of the box in the present invention.

The box 2 has four conventional sized end flaps 4, 6, 8, and 10 on the top and the bottom of the box. The bottom end flaps (not shown) are folded shut in the same manner as the top flaps are when the box 2 is ready to be closed up for shipment, preferably in a manner that will be described shortly, and taped shut. The closure tape must be strong and tough and preferably about three inches wide. Acceptable tapes are Nos. 375 and 8959 offered by the Minnesota Mining and Manufacturing Company, No. 745 offered by the Anchor Continental, Inc., and No. 260 offered by the Central Tape Company. These tapes are polyester or reinforced polyester or reinforced paper tapes.

The tape strip 34 can be applied in a conventional manner on the end of the box 2, i. e. across the bottom end of the box 2 covering a joint formed between the ends of two adjacent end closure flaps and extending up a few inches, like 2–3 inches or more, on the exterior of two opposing vertical walls of the box. This will be adequate to get the filter product to the customer in expected good condition. However, to meet the UN-DOT Group II and III standard the tape must also be applied completely around the periphery of the bottom of the box 2 with tape attached to the bottom closure flaps and the vertical walls of box 2 as shown in FIG. 1 at 36, followed by a repeat of the conventional tape strip 34 over the initial strip 34 and the peripheral strip 36. If the bottom of the box 2 is taped in this manner by the manufacturer of the new product, this saves the customer from having to do it in his shop, but is optional for the product manufacturer.

Next, a plastic liner bag 12, being larger than the box and extending far enough above the box to effect a good tie as described later, is placed in the box 2. This liner bag is at least about 4 mils thick and is typically made of low density polyethylene with an anti-stat additive and containing at least about 2.5, preferably at least about 5 and most preferably about 7.5 wt. percent ethylene vinyl acetate (EVA) to improve flexibility, particularly in cold weather. Next, a corrugated kraft egg crate type separator 14 is placed inside the plastic liner inside the box, as shown in FIG. 1. The partitioning separator 14 can be made of 200 pound or heavier C Flute kraft corrugated (cardboard) and can form compartments to hold one or more filter cartridges 46. In a preferred embodiment shown in FIG. 1, the partition 14 is a conventional fold flat construction, but arranged in a novel way. The compartments 16, 20, 28 and 32 are sized to hold four cartridges, the intermediate compartments 18,22, 26 and 30 are sized to hold two cartridges each and the internal compartment 24 is sized to hold a single cartridge 46. This novel arrangement offers the protection needed to meet the UN-Dot Group II requirement for the least cost, but other configurations are possible.

After the heavy gauge box 2 is filled with filter cartridges, the plastic liner bag 12 is then folded flat on top of the cartridges and the top flaps are closed and taped shut for shipment to the customer. Optionally, at least an equal number of 4 mil tubular plastic sleeves (bags), each long enough to hold one cartridge with enough bag left over to effect a good tie, as there are cartridges in the box are placed in the box on top of the filter cartridges or bag liner. Optionally, these sleeves (bags) can be shipped in a separate container. These tubular plastic sleeves or bags, which can be a low density polyethylene with an anti-stat additive with EVA, are at least 3 mils, and preferably about 4 mils or thicker, will be used to contain the spent cartridges.

When customers open the inventive package, they are instructed to do so by carefully slitting the tape at the top of the box so as to not damage the kraft package. The top closure flaps 4, 6, 8 and 10 are folded open, and if the package includes a liner bag 12, it is unfolded, and if tied it is untied. Next the tubular plastic bags (see 39 of FIG. 2), if they are in the package, are removed and placed in a convenient place for safekeeping until they are needed. Some customers might find it more convenient to receive the bag liner 12, separator partition 14, protective discs 44 and 45 and/or the tubular plastic sleeves for bags 39 separately, thus requesting that the bags and/or other items not be shipped inside the boxes of filter cartridges. Next, one or more cartridges are removed from the box for use.

Referring to FIGS. 1 and 2–5, when a spent cartridge 46 is removed from a filter housing, and before it is placed back into the box 2 to produce an inventive package, the box 2 must have the bag liner 12 inside and the separating partition 14 inside the bag liner 12. Also, the spent filter 46 must first be placed inside one of the tubular plastic bags 39 and, if the cartridge has a conventional core liner, with a plastic disc 44 and 45 at each end to protect the sleeve. The spent filter cartridge 46 is put into the bag 39 in a careful manner to avoid damaging the bag 39 and to avoid getting hazardous material on the exterior of the bag 39.

Figure 2:
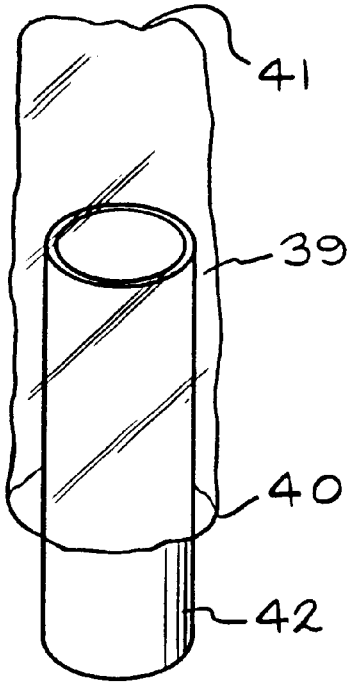
FIGS. 2–5 are perspective views showing how the spent cartridges are prepared according to the method of the present invention to be placed back into the container used in the package of the present invention.
Figure 3:
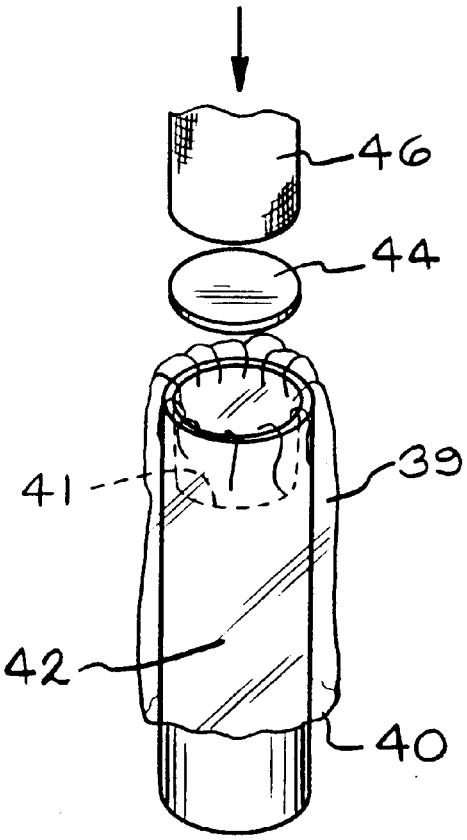
Figure 6:
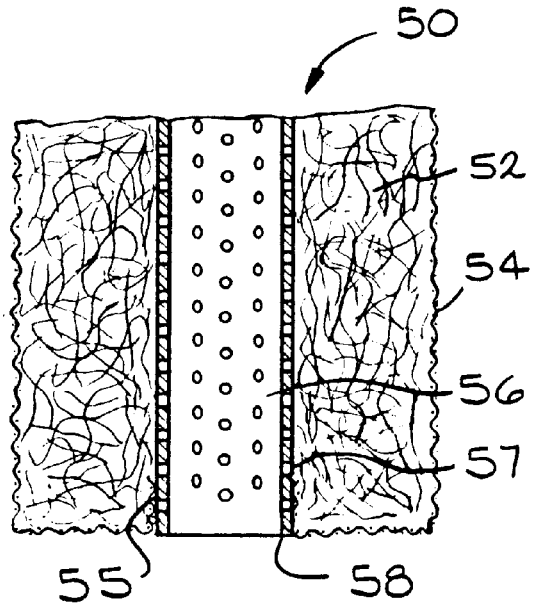
FIG. 6 is a cross section of an end portion of a conventional filter cartridge having a permeable core liner.

Referring to FIG. 2, a tool 42, such as a section of a PVC plastic thin walled pipe having an inside diameter somewhat larger than the outside diameter of the filter cartridge and being shorter than the cartridge, preferably by 2–3 inches, can be used to place the spent cartridge in the sleeve 39 in a safe and reliable way. The open end 40 of the bag 39 is slid over and down the length of the tool 42 until the closed end 41 of the bag 39 is about flush with the end of the tool 42 as shown in FIG. 3. Then, if using optional plastic discs to protect the bag 39, a disc 44 is set on the end 41 of the bag 39 and the spent filter cartridge 46 is lowered onto the disc 44 and on into the interior of the tool 42. Although many materials can be used to make the discs and to various sizes, a suitable disc for use with filter cartridges is cut from polypropylene or polyethylene sheet about 15–25 mils thick to a diameter of about 2.5 inches. The diameter of the disc should be larger than the outside diameter of the core liner (see 57 in FIG. 6) and smaller than the outside diameter of the cartridge 46.

Figure 4:
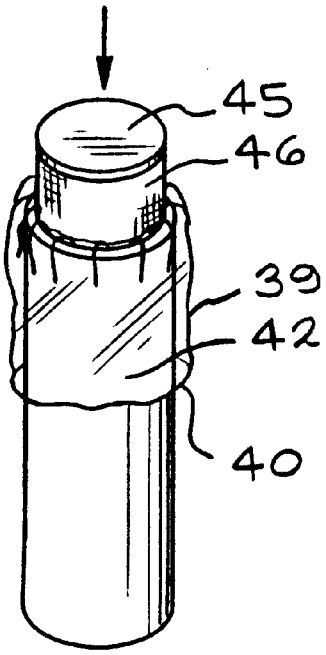
Figure 5:
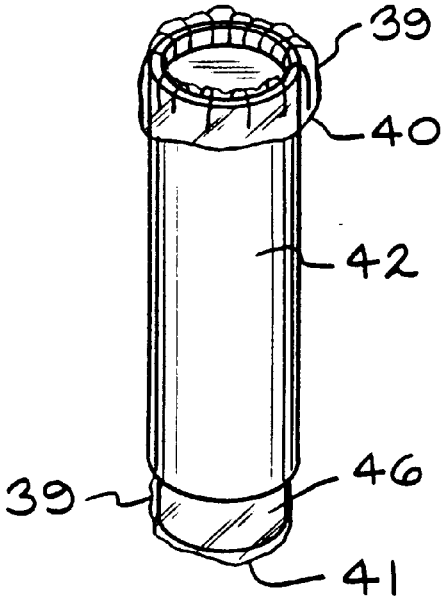

As the cartridge 46 is pushed on into the tool 42, as shown in FIG. 4, it pulls the sleeve 39 along with it so that the surface of the cartridge 46 never contacts the tool 42 directly. When the top of the cartridge 46 is close to being inside the tool 42, as shown in FIG. 4, another disc 45, just like 44, is placed on top of the end of the cartridge 46 inside of sleeve 39. Then the cartridge 46 and sleeve 39 are pulled completely through the tool 42 as shown in progress in FIG. 5. This leaves the cartridge 46, optionally with a protective disc on each end of the cartridge, completely in the sleeve 39. The top portion 40 of the sleeve 39 above the top disc 44 or top of the cartridge 46, is twisted to remove excess air in the sleeve, forming a strand like portion that is then tied in a knot in a known manner to seal the sleeve 39.

The tubular sleeve containing the spent filter cartridge 46 is placed back into one of the compartments formed by the partitioning separator 14 inside the bag liner 12 and the box 2 and the knotted end of the sleeve is tucked into a space in the compartment between the cartridge and the wall of the box 2 or partition 14 as shown in compartment 28 in FIG. 1.

When the partitioning separator compartments are filled with spent filter cartridges, the liner bag 12 is gathered carefully at the top, twisted to remove excess air and to form a strand of twisted plastic film and tightly secured with the tape mentioned above forming a long tail. After taping to form a long tail, the tail is folded in half and tightly taped again so as not to come loose or to permit the bag to come open or leak out any liquid or particulate that might be in the spent filters. Finally, the top closure flaps 8 and 10 are folded shut and then flaps 4 and 6 are folded shut and taped in the same manner as described above for the bottom flaps and as shown in FIG. 1, or with any pattern that meets the requirements established for United Nations Certification of a combination package for UN NA 3085 for Group II Packs.

The package of the present invention, containing spent filter cartridges, was tested severely in accordance with the specified tests as established in United States Code of Federal Regulation, Section 49, Subchapter C, Hazardous Materials Regulations, Parts 100–199, and A.S.T.M. D4919-89 entitled "Standard Specification for Testing of Hazardous Materials Packagings" and, when the package did not exceed about 165 pounds in weight for 30, 20 and 10 inch long cartridges and did not exceed about 190 pounds for 40 inch long cartridges, met all of the requirements to achieve certification as a combination package for UN NA 3085 for Group II Packs (Combination Pak 4G UN Packing Group II) per gh Package & Product Testing and Consulting, Inc. of Cincinnati, Ohio.

The package, after attaching the appropriate labels, is now ready to be picked up by the hazardous waste disposal carrier. Since this package has been certified for UN-Dot Group II and III hazardous materials, the disposal company provides all paperwork essentially completed requiring very little paperwork by the filter cartridge user compared to the previous methods of disposal. Packaged in this manner, spent filter cartridges, box and all, can be ground up. The liquids collected are used as a primary fuel in a cement kiln or other furnace while the remaining material is used as a secondary fuel in the same cement kiln. The cement manufacturers pay to get these packages to use for fuel which reduces the cost of disposal to the filter cartridge user.

These packages reduce freight and disposal costs also because with the above package 450 thirty inch cartridges can be placed on a pallet whereas using 55 gallon drums only 212 thirty inch cartridges can be placed on a pallet (53 cartridges per drum and 3 or 4 drums per pallet). The steel drums weigh more than the cardboard boxes adding to freight costs and cannot be ground up with the cartridges for fuel thus requiring extra labor to remove the cartridges from the drums and to clean up the drums for reuse or salvage.

Further explanation is required to understand when to use the optional discs 44 and 45, and to describe another feature of the invention. A typical filter cartridge is shown in partial cross section in FIG. 6 at 50. The filtering media 52 always has an open core down its axis to allow the material to be filtered to either enter or exit the filter cartridge. This core is usually, but not always, lined with a metal or plastic core liner 57 which also acts to hold a permeable cover 54 onto the filter media 52 by tucking the ends of the cover or sock into the end portions of the cartridge and holding the ends of the sock in place with the core liner 57 at 55. The core liner 57 is permeable, being made of a perforated material and the core liner ends 58 are usually flush with the ends of the filter cartridge 50. Even if the core liner ends 58 are recessed at the ends of the cartridge, a hard jolt can cause the core liner ends 58 to slide to the end of the cartridge, and being somewhat sharp due to being of a thin material, the liner ends 58 can puncture the bags 39 and even the bag liner 12, which is unacceptable. To prevent this, the discs 44 and 45 are used when disposing of spent cartridges of the type shown in FIG. 6 having a metal or plastic core liner. The discs must be larger in circumference than the core liner of the cartridges, but need not be as large in diameter as the cartridge.

Figure 7:
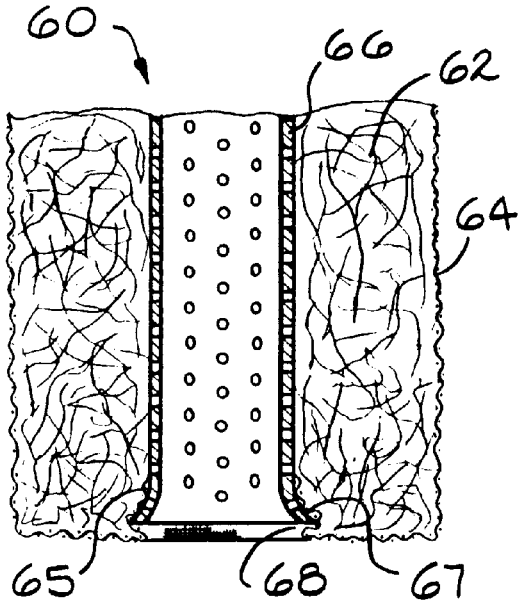
FIG. 7 is a cross section of an end portion of a new filter cartridge of the present invention particularly useful with the package and method of the present invention.

A new filter cartridge having a core liner has been developed that avoids the need to use the protective discs 44 and 45. This cartridge is shown in partial cross section in FIG. 7. This cartridge 60 is identical to cartridge 50 shown in FIG. 6 except that the end portion 67 of each end of the metal or plastic core liner 66 has been flared out into the filtration media 62 to lock the core liner 66 into the cartridge such that it can't slide along the core of cartridge 60. While being flared, the ends of the flared end portions 67 become recessed back from the ends of the cartridge 60 as shown at 68. The outer membrane or sock 64 is also held more tightly by being forced into the filtration media as seen at 65 by the flared end portions 67. Therefore, discs 44 are not required when disposing of this new type of cartridge which saves material costs and time in packaging the spent filters. It is not necessary to flare the entire periphery of the ends of the core liner to achieve the same objective—only a portion of the periphery need be flared, optionally by either stretching only a portion of the end portion of the core liner or first making slits in the end portions and then flaring or deforming the portion between the slits into the filter media of the cartridge. Any other obvious manner of adhering or of deforming a portion of the core liner onto or into the filter media to hold the core liner from sliding inside the cartridge would be suitable so long as the ends of the core liner are recessed from the ends of the cartridge in the completed cartridge.

Figure 8:
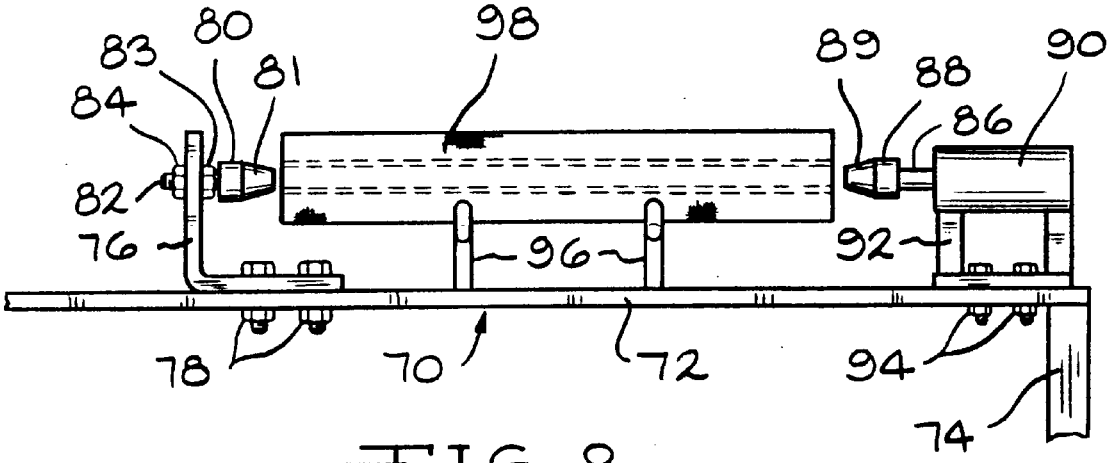
FIG. 8 is an elevation view of an apparatus used to make the new filter cartridge shown in FIG. 7.

FIG. 8 shows apparatus 70 used to make the preferred filter cartridges with the flared end portions of the core liner. A base member 72 having a slot down its center extending almost to each end of member 72 is supported by any suitable means such as by legs 74. Towards one end of the base an L shaped bracket 76 is attached to the base 72 by bolts 78 which pass through the slot in the base 72. By loosening bolts 78 the bracket can be moved along the base to a proper position for processing cartridges of different lengths, and then retightened. A round flaring tool 80 having a cone shaped working surface 81 is rigidly mounted to the bracket 76 with a shaft 82 and nuts 83 and 84.

On the opposite end portion of the base 72 is mounted a support 92 with bolts 94. Fastened to the support 92 is a fluid, gas or liquid actuated cylinder 90 having a movable rod 86 and another round flaring tool 88 with a conical working surface 89 attached to the end of the rod 86. In the center of the base are two or more work or cartridge holder cradles 96 which hold a cartridge such that the axis of the core is aligned with the axis of the flaring tools 80 and 88. Flaring is very well known and the manner of making flaring tools for accomplishing the task described here is well within those skilled in the art of flaring.

To operate apparatus 70 to make the new cartridge 60 first the bracket 76 is adjusted along base 72 such that when a cartridge is placed in cradles 96, the ends of the cartridge are very near the ends of working surfaces 81 and 89. Next a cartridge, like 50, preferably with a metal core liner, is placed in the cradles 96 and cylinder 90 is activated with air or hydraulics to move the working surfaces 81 and 89 of tools 80 and 88 into each end of the core liner 57 to flare both ends like that shown in FIG. 7. The cylinder 90 is then reversed and the cartridge is removed and ready for packaging.

When a thermoplastic core liner is used it is first necessary to heat each extreme end portion to a temperature high enough to soften the thermoplastic prior to flaring using a heating element in close proximity to each end or by any known means of heating without damaging any part of the cartridge, and also to cool the flaring tools by internal water cooling in a known manner or other known means such that the plastic can be first deformed in the plastic state and then cooled with the cold flaring tool to retain the flared shape. Thermoplastic core liners can be made from any thermoplastic material compatible with the process such as Nylon™, polyester, polypropylene, polyethylene, etc. It is well known in the art how to heat an end portion of a thermoplastic tube to soften it for reforming so that technique need not be repeated here. Any known and proven means for doing this will be suitable so long as the other parts of the cartridge are not damaged.

Other modifications and embodiments of this invention will be obvious to and within the skill of those having ordinary skill in this art after having the benefit of this disclosure and those modifications and embodiments are intended to be included within the scope of the following claims.

We claim:

1. A package, including product for use in such a way that, when spent, will contain hazardous material, comprising, a cardboard box containing said product, said box having an exterior joining flap glued to a vertical surface of said box and extending for at least almost the entire height of the box when the box is closed, said box having closure flaps on the top and the bottom, said cardboard having a burst strength of at least 300 pounds and substantially higher than the 150–200 pounds burst strength cardboard required and conventionally used to protect the product from expected shipping and handling abuse, said closure flaps on the bottom and top of the box being fastened shut.

2. The package of claim 1 wherein said cardboard has a burst strength of at least about 325 pounds.

3. The package of claim 1 wherein said cardboard has a burst strength of at least about 350 pounds.

4. The package of claim 1 wherein said package also comprises a bag liner made from a plastic film, said bag liner being larger than said box.

5. The package of claim 2 wherein said package also comprises a bag liner made from a plastic film, said bag liner being larger than said box.

6. The package of claim 3 wherein said package also comprises a bag liner made from a plastic film, said bag liner being larger than said box.

7. The package of claim 4 wherein said bag liner has a strength and toughness equivalent to about a 4 mil thick low density polyethylene containing an anti-stat additive and sufficient EVA to prevent embrittlement at cold temperatures.

8. The package of claim 5 wherein said bag liner has a strength and toughness equivalent to about a 4 mil thick low density polyethylene containing an anti-stat additive and sufficient EVA to prevent embrittlement at cold temperatures.

9. The package of claim 6 wherein said bag liner has a strength and toughness equivalent to about a 4 mil thick low density polyethylene containing an anti-stat additive and sufficient EVA to prevent embrittlement at cold temperatures.

10. The package of claim 7 wherein said package also comprises a plurality of plastic film sleeves closed at one end and open at the other end, each sleeve being large enough to hold one spent filter cartridge with enough sleeve at the open end extending beyond the cartridge to enable twisting to form a tail long enough for tying a knot in the tail.

11. The package of claim 8 wherein said package also comprises a plurality of plastic film sleeves closed at one end and open at the other end, each sleeve being large enough to hold one spent filter cartridge with enough sleeve at the open end extending beyond the cartridge to enable twisting to form a tail long enough for tying a knot in the tail.

12. The package of claim 9 wherein said package also comprises a plurality of plastic film sleeves closed at one end and open at the other end, each sleeve being large enough to hold one spent filter cartridge with enough sleeve at the open end extending beyond the cartridge to enable twisting to form a tail long enough for tying a knot in the tail.

13. The package of claim 4 wherein said package further comprises a cardboard separator that separates said box into a plurality of compartments.

14. The package of claim 13 wherein said product is filter cartridges and said package also comprises a plurality of plastic film sleeves closed at one end and open at the other end, each sleeve being large enough to hold one spent filter cartridge with enough sleeve at the open end extending beyond the cartridge to enable twisting to form a tail long enough for tying a knot in the tail.

15. The package of claim 5 wherein said package further comprises a cardboard separator that separates said box into a plurality of compartments.

16. The package of claim 15 wherein said product is filter cartridges and said package also comprises a plurality of plastic film sleeves closed at one end and open at the other end, each sleeve being large enough to hold one spent filter cartridge with enough sleeve at the open end extending beyond the cartridge to enable twisting to form a tail long enough for tying a knot in the tail.

17. The package of claim 6 wherein said package further comprises a cardboard separator that separates said box into a plurality of compartments.

18. The package of claim 17 wherein said product is filter cartridges and said package also comprises a plurality of plastic film sleeves closed at one end and open at the other end, each sleeve being large enough to hold one spent filter cartridge with enough sleeve at the open end extending beyond the cartridge to enable twisting to form a tail long enough for tying a knot in the tail.

19. The package of claim 14 wherein said package further comprises a plurality of protective discs to use to prevent damage to said bag liner from spent cartridges.

20. The package of claim 16 wherein said package further comprises a plurality of protective discs to use to prevent damage to said bag liner from spent cartridges.

21. The package of claim 18 wherein said package further comprises a plurality of protective discs to use to prevent damage to said bag liner from spent cartridges.

22. A package of spent product containing hazardous material that is useful as a fuel for kilns or furnaces and meeting the requirements established by UN-DOT for shipping Group II and III hazardous waste and to achieve certification as a combination package for UN NA 3085 for Group II Packs when tested in accordance with the specified tests as established in United States Code of Federal Regulation, Section 49, Subchapter C, Hazardous Materials Regulations, Parts 100–199, comprising a box made of cardboard having a burst strength of at least about 300 pounds, said box fabricated using a glued exterior joining flap, said box having closure flaps on two ends of the box with the closure flaps closed and sealed in a manner meeting the above stated requirements, said box having a sealed bag liner of plastic film that is larger than said box, a cardboard partitioning separator inside said bag liner for separating said box into compartments, said spent product being sealed in sleeves of plastic film and residing in said compartments.

23. The package of claim 22 wherein said box is made of cardboard having a burst strength of at least about 325 pounds.

24. The package of claim 22 wherein said box is made of cardboard having a burst strength of at least about 350 pounds.

25. The package of claim 22 wherein the two ends of said box having said closure flaps are closed and taped shut and sealed with a first applied tape down the center covering the joint between the flaps and extending up opposite vertical sidewalls of the box at least about 3 inches, taped entirely around the periphery of said two ends of said box, the tape extending from the exterior of the flaps around the edges of the box and extending up the vertical sidewalls of the box at least about one inch, and finally another strip of tape placed at least substantially over said first applied strip of tape.

26. The package of claim 23 wherein the two ends of said box having said closure flaps are closed and taped shut and sealed with a first applied tape down the center covering the joint between the flaps and extending up opposite vertical sidewalls of the box at least about 3 inches, taped entirely around the periphery of said two ends of said box, the tape extending from the exterior of the flaps around the edges of the box and extending up the vertical sidewalls of the box at least about one inch, and finally another strip of tape placed at least substantially over said first applied strip of tape.

27. The package of claim 24 wherein the two ends of said box having said closure flaps are closed and taped shut and sealed with a first applied tape down the center covering the joint between the flaps and extending up opposite vertical sidewalls of the box at least about 3 inches, taped entirely around the periphery of said two ends of said box, the tape extending from the exterior of the flaps around the edges of the box and extending up the vertical sidewalls of the box at least about one inch, and finally another strip of tape placed at least substantially over said first applied strip of tape.

28. The package of claim 25 further comprising protective discs inside said sleeves and on at least one end of each spent cartridge.

29. The package of claim 26 further comprising protective discs inside said sleeves and on at least one end of each spent cartridge.

30. The package of claim 27 further comprising protective discs inside said sleeves and on at least one end of each spent cartridge.

31. A package including a plurality of spent products having hazardous material therein and meeting the requirements established for United Nations Certification of a combination package for UN NA 3085 for Group II Packs comprising the box that the new product was received in and having an exterior joining flap glued to a vertical surface of said box and extending for at least almost the entire height of the box when the box is closed, said box having closure flaps on the top and the bottom, said cardboard having a burst strength of at least 300 pounds and substantially higher than required and conventionally used to protect the new product from expected shipping and handling abuse, said spent product being sealed in plastic bags and residing in compartments formed by a separator inside an about 4 mil plastic bag liner inside said box, said closure flaps on the bottom and top of the box being fastened shut by a first conventionally placed tape strip extending across the top and bottom of the box and extending a few inches up or down opposing sidewalls of the box, a tape strip running around the periphery of the top and bottom of the box extending from the exterior of the closure flaps and onto the sidewalls of the box, and finally with a second strip of tape placed substantially over said first tape strip.

32. The package of claim 31 wherein said spent product is a plurality of spent filter cartridges and wherein a protective disc larger in diameter than that of a core liner in said filter cartridge resides at the bottom end and top end of each filter cartridge having a core liner and inside one of said bags.

* * * * *